US010486001B1

(12) United States Patent
Bailey et al.

(10) Patent No.: US 10,486,001 B1
(45) Date of Patent: Nov. 26, 2019

(54) SCENTED PLEATED FACE MASK

(71) Applicants: Michelle Bailey, San Diego, CA (US); Ken Bloch, San Diego, CA (US)

(72) Inventors: Michelle Bailey, San Diego, CA (US); Ken Bloch, San Diego, CA (US)

(73) Assignee: Michelle Bailey, San Diego, CA (US)

( * ) Notice: Subject to any disclaimer, the term of this patent is extended or adjusted under 35 U.S.C. 154(b) by 0 days.

(21) Appl. No.: 16/511,108

(22) Filed: Jul. 15, 2019

Related U.S. Application Data

(63) Continuation of application No. 16/435,476, filed on Jun. 8, 2019.

(51) Int. Cl.

| | |
|---|---|
| ***A62B 23/00*** | (2006.01) |
| ***A41D 13/00*** | (2006.01) |
| ***A62B 23/02*** | (2006.01) |
| ***A41D 13/11*** | (2006.01) |
| *A62B 18/02* | (2006.01) |

(52) U.S. Cl.
CPC ..... *A62B 23/025* (2013.01); *A41D 13/1115* (2013.01); *A41D 13/1192* (2013.01); *A41D 13/1161* (2013.01); *A41D 2400/36* (2013.01); *A62B 18/025* (2013.01)

(58) Field of Classification Search
CPC ..... A41D 13/1115; A62B 23/025
USPC ..... 128/206.19
See application file for complete search history.

(56) References Cited

U.S. PATENT DOCUMENTS

| | | | | |
|---|---|---|---|---|
| 4,503,851 | A * | 3/1985 | Braunroth | A41D 13/1192 128/203.29 |
| 5,538,013 | A * | 7/1996 | Brannon | A41D 13/1146 128/857 |
| 5,891,508 | A * | 4/1999 | Barnum | A41D 13/1115 128/206.12 |
| 6,758,215 | B2 * | 7/2004 | Begum | A41D 13/1161 128/202.15 |
| 6,779,524 | B2 * | 8/2004 | Strawder | A61M 16/06 128/206.21 |
| 2005/0081856 | A1 * | 4/2005 | Cheng | A41D 13/1192 128/205.25 |
| 2006/0107959 | A1 * | 5/2006 | Plummer, Jr. | A41D 13/1192 128/206.19 |
| 2012/0090616 | A1 * | 4/2012 | Means | A41D 13/1192 128/206.19 |

(Continued)

*Primary Examiner* — Bradley H Philips
(74) *Attorney, Agent, or Firm* — Manuel de la Cerra

(57) ABSTRACT

A scented mask is disclosed that includes: a filter region with one or more pleats that include a mask material and a pleat fold; and one or more scented patches. Each scented patch includes a patch lid attached to the mask material before the pleat fold; a patch-impermeable layer attached to the mask material after the pleat fold; and a layer impregnated with a scent agent attached to the patch-impermeable layer. The mask is constructed to transition from a sealed configuration to an unsealed configuration when a user places the mask over her nose and mouth: the sealed configuration where the mask material before and after the pleat fold are folded on each other and the patch lid covers and seals the impregnated layer, inhibiting the vaporization of the scent agent; and the unsealed configuration where the pleat fold is opened and the patch lid is separated from the impregnated layer, allowing for the vaporization of the scent agent.

18 Claims, 5 Drawing Sheets

(56) References Cited

U.S. PATENT DOCUMENTS

| | | | | |
|---|---|---|---|---|
| 2012/0144556 | A1* | 6/2012 | Fiebel | A41D 13/11 2/206 |
| 2014/0237695 | A1* | 8/2014 | Al Malki | A41D 13/11 2/9 |
| 2017/0021205 | A1* | 1/2017 | Delatorre | A41D 13/11 |

* cited by examiner

SCENTED PLEATED FACE MASK

1.0 TECHNICAL FIELD

The present invention generally relates to face masks used in the medical field, and other industrial applications.

2.0 BACKGROUND

Face masks have been used throughout the medical industry not only for the medical provider but also for the patient. Personal protective equipment (PPE) refers to face masks and other protective clothing, helmets, gloves, face shields, goggles, and/or respirators or other equipment designed to protect the wearer from injury or the spread of infection or illness. PPE is commonly used in health care settings such as hospitals, doctor's offices and clinical labs. When used properly, PPE acts as a barrier between infectious materials such as viral and bacterial contaminants and the skin, mouth, nose, or eyes (mucous membranes). The barrier has the potential to block transmission of contaminants from blood, body fluids, or respiratory secretions. PPE may also protect patients who are at high risk for contracting infections through a surgical procedure or who have a medical condition, such as, an immunodeficiency from being exposed to substances or to potentially infectious materials brought in by visitors and healthcare workers. When used properly with other infection control practices such as hand-washing, using alcohol-based hand sanitizers, and covering coughs and sneezes, PPE minimizes the spread of infection from one person to another. Effective use of PPE includes properly removing and disposing of contaminated PPE to prevent exposing both the wearer and other people to infection.

If worn properly, a face mask is a barrier that helps block large-particle droplets, splashes, sprays or splatters that may contain germs (viruses and bacteria). This barrier either keeps that fluid from escaping into the environment or from entering into the wearer's mouth and nose.

By applying a scent agent to the face mask, the medical provider may be able to provide longer bedside care. Also, and perhaps more importantly, a cancer patient wearing a scented face mask may feel more comfortable, decreasing the quantity of medications the patient consumes (less anti-nausea medications for example). For instance, in one case study, a patient emerging from a successfully completed chemotherapy regimen attempted to purchase a juice drink at a local store. The smells in that juice store, however, triggered nausea, loss of appetite and other symptoms. (This distorted association is not uncommon for cancer patients. Often times patients associate certain things to taste and smells, causing anxiety, nutritional complications and difficult quality of life indications.) The sensitivity of smell started affecting this patient in the hospital as well. Each time the patient would enter the hospital for routine labs and chemotherapy, the nausea would begin and cause the patient to not want to enter the building. Home care was also affected because the smell of chemotherapy was all over the bed, sheets, room and parts of the house.

A scented face mask can mitigate these nausea-triggering smells. However, past face mask designs simply applied a scent to the mask material, and that scent would vaporize off the mask very quickly. Other scented masks were placed in a sealed bag to prevent the vaporization and prolong the shelf life of the mask. This too, had its drawbacks in that the user could not simply place the mask on their face; rather, they would need to remove the sealed packaging and then wear the mask. This is time consuming, potentially less hygienic, and creates more waste.

What is needed, therefore, is a scented face mask, with a prolonged shelf life that will begin to release its scent once the user places the mask on her face.

3.0 SUMMARY

A scented mask is disclosed that includes: a filter region with one or more pleats that includes a mask material and a pleat fold as well as one or more scented patches. Each scented patch includes a patch lid attached to the mask material before the pleat fold, a patch-impermeable layer attached to the mask material after the pleat fold, and a layer impregnated with a scent agent attached to the patch-impermeable layer. The mask is constructed to transition from a sealed configuration to an unsealed configuration when a user places the mask over his or her nose and mouth: the sealed configuration, where the mask material before and after the pleat fold are folded on each other and the patch lid covers and seals the impregnated layer, inhibiting the vaporization of the scent agent, and the unsealed configuration, where the pleat fold is opened and the patch lid is separated from the impregnated layer, allowing for the vaporization of the scent agent.

The mask may include an elastic strap to maintain the position of the mask on the user. A memory metal strip may be included to shape an edge of the mask around the user's nose.

The scented patch may include a diffusion layer that covers at least a portion of the impregnated layer when in the unsealed configuration, so as to reduce the rate of vaporization of the scent agent. The scented patch may have an aesthetic shape, like that of a butterfly silhouette. The scented patch may include an indicator that is hidden when the mask is in the sealed configuration and exposed when the mask is in the unsealed configuration. The indicator may be a color and/or a pattern.

The impregnated layer may be constructed from plastic films with pores or micro-holes, paper, sponge-like films, films with encapsulated scent agents, treated plastic films, and combinations thereof. The impregnated layer may be exposed on the face-side of the mask when in the unsealed configuration. The patch lid and the patch-impermeable layer may be attached to the mask material by an adhesive, mechanical fastener or ultrasonic welding. The patch lid and patch-impermeable layer may be connected to each other by a patch hinge, and the patch hinge may be adjacent to the pleat fold.

The scent agent may include a binding agent or an antimicrobial that is selected from a group consisting of: carboxymethyl cellulose, pullulan, hydroxypropyl methyl cellulose, hydroxyethyl cellulose, hydroxypropyl cellulose, polyvinyl pyrrolidone, polyvinyl alcohol, sodium alginate, polyethylene glycol, Xanthan gum, tragacanth gum, guar gum, acacia gum, arabic gum, polyacrylic acid, methyl methacrylate copolymer, carboxyvinyl polymer, amylose, high amylose starch, hydroxypropylated high amylose starch, dextrine, pectin, chitin, chitosan, levan, elsinan, collagen, gelatin, Zein, gluten, soy protein isolate, whey protein isolate, casein, and any combination thereof.

Additional aspects, alternatives and variations as would be apparent to persons of skill in the art are also disclosed herein and are specifically contemplated as included as part of the invention. The invention is set forth only in the claims as allowed by the patent office in this or related applications, and the following summary descriptions of certain examples are not in any way to limit, define or otherwise establish the scope of legal protection.

4.0 BRIEF DESCRIPTION OF THE DRAWINGS

The invention can be better understood with reference to the following figures. The components within the figures are not necessarily to scale, emphasis instead being placed on clearly illustrating example aspects of the invention. In the figures, like reference numerals designate corresponding parts throughout the different views and/or embodiments. Furthermore, various features of different disclosed embodiments can be combined to form additional embodiments, which are part of this disclosure. It will be understood that certain components and details may not appear in the figures to assist in more clearly describing the invention.

5.0 DETAILED DESCRIPTION

Figure 1:
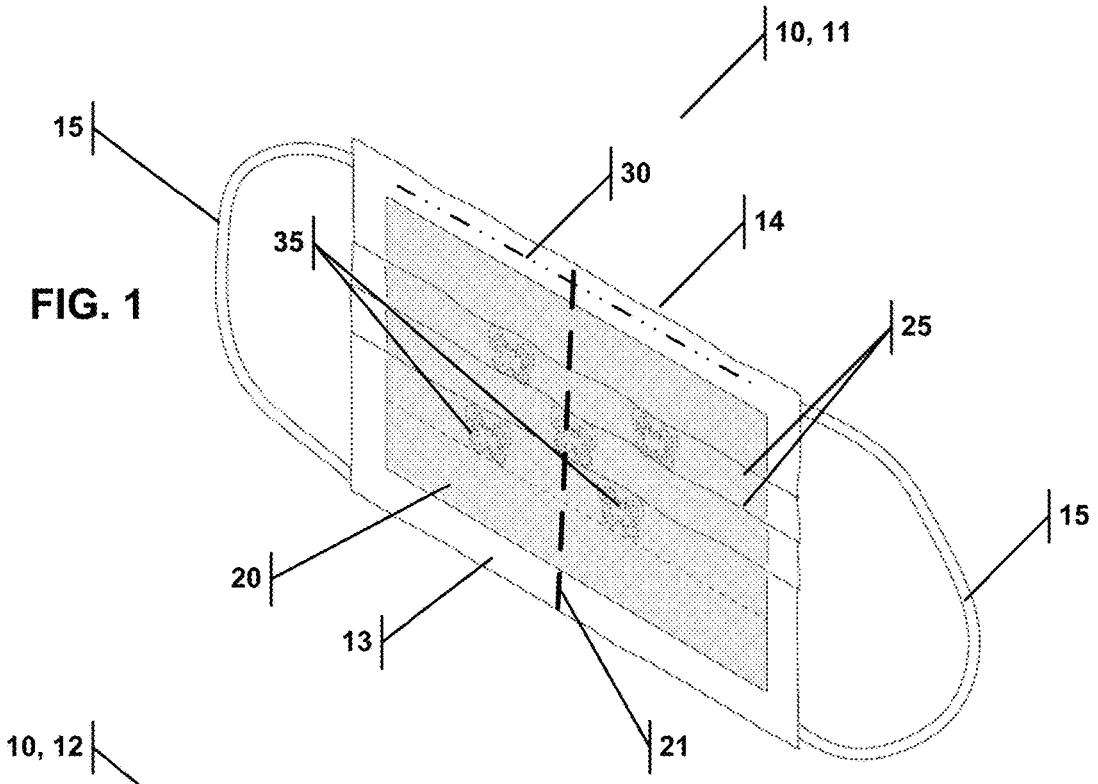
FIG. 1 is an isometric view of a scented face mask in a sealed configuration.

Reference is made herein to some specific examples of the present invention, including any best modes contemplated by the inventor for carrying out the invention. Examples of these specific embodiments are illustrated in the accompanying figures. While the invention is described in conjunction with these specific embodiments, it will be understood that it is not intended to limit the invention to the described or illustrated embodiments. To the contrary, it is intended to cover alternatives, modifications, and equivalents as may be included within the spirit and scope of the invention as defined by the appended claims.

In the following description, numerous specific details are set forth in order to provide a thorough understanding of the present invention. Particular example embodiments of the present invention may be implemented without some or all of these specific details. In other instances, process operations well known to persons of skill in the art have not been described in detail in order not to obscure unnecessarily the present invention. Various techniques and mechanisms of the present invention will sometimes be described in singular form for clarity. However, it should be noted that some embodiments include multiple iterations of a technique or multiple mechanisms unless noted otherwise. Similarly, various steps of the methods shown and described herein are not necessarily performed in the order indicated, or performed at all in certain embodiments. Accordingly, some implementations of the methods discussed herein may include more or fewer steps than those shown or described. Further, the techniques and mechanisms of the present invention will sometimes describe a connection, relationship or communication between two or more entities. It should be noted that a connection or relationship between entities does not necessarily mean a direct, unimpeded connection, as a variety of other entities or processes may reside or occur between any two entities. Consequently, an indicated connection does not necessarily mean a direct, unimpeded connection unless otherwise noted.

The following list of example features corresponds with the attached figures and is provided for ease of reference, where like reference numerals designate corresponding features throughout the specification and figures:

Face Mask 10
Sealed Configuration 11
Unsealed Configuration 12
Face-side of Mask 13
Environment-side of Mask 14
Elastic Ear Straps 15
Filter Region (Shaded) 20
Filter Region Height (Sealed Configuration) 21
Filter Region Height (Unsealed Configuration) 22
Pleats 25
Pleat Fold 26
Pleat Fold Opened 27
Memory Metal Strip 30
Scented Patch 35
Mask Material Before Pleat Fold 37
Mask Material After Pleat Fold 38
Patch Lid Adhesive Layer 40
Patch Lid 45
Colored/Patterned Exposed Face of Patch Lid For Indicating Unsealed Configuration 46
Patch Diffusion Layer 50
Colored/Patterned Exposed Face of Patch Diffusion Layer/Impregnated Layer For Indicating Unsealed Configuration 51
Patch Scent-Impregnated Layer 55
Patch-Impermeable Layer 60
Patch Adhesive Layer 65
Scented Patch (Clamshell) 70
Patch Hinge 75
Seal Edge 80

FIG. 1 presents an isometric view of a scented face mask 10 in a sealed configuration 11. The mask 10 has a filter region (shaded) 20, and a face-side 13 that is in designed to contact with the user's face and an environment-side 14 opposite to the face-side 13. The filter region 20 has one or more pleats 25, each pleat comprised of a mask material and a pleat fold 26. Within these pleats 25 is one or more scented patches 35. The mask 10 may include one or more elastic straps 15 to maintain the position of the mask on the user. A memory metal strip 30 may be included to shape an edge of the mask around the user's nose.

Figure 3:
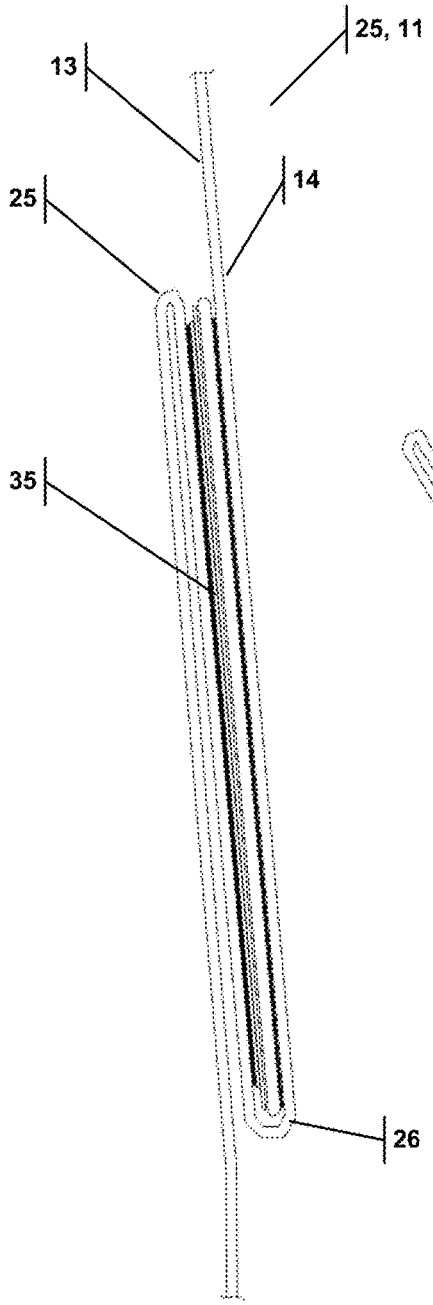
FIG. 3 is a cross-sectional view of a pleat of the scented face mask in a sealed configuration.
Figure 4:
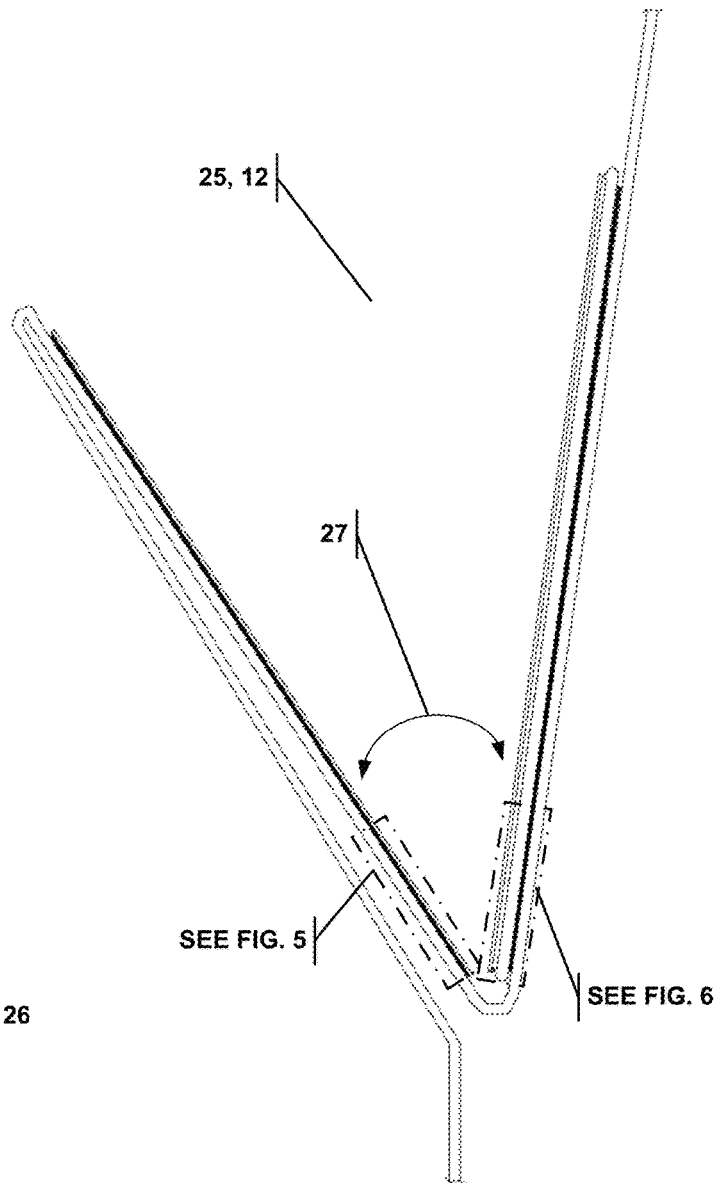
FIG. 4 is a cross-sectional view of a pleat of the scented face mask in an unsealed configuration.
Figure 5:
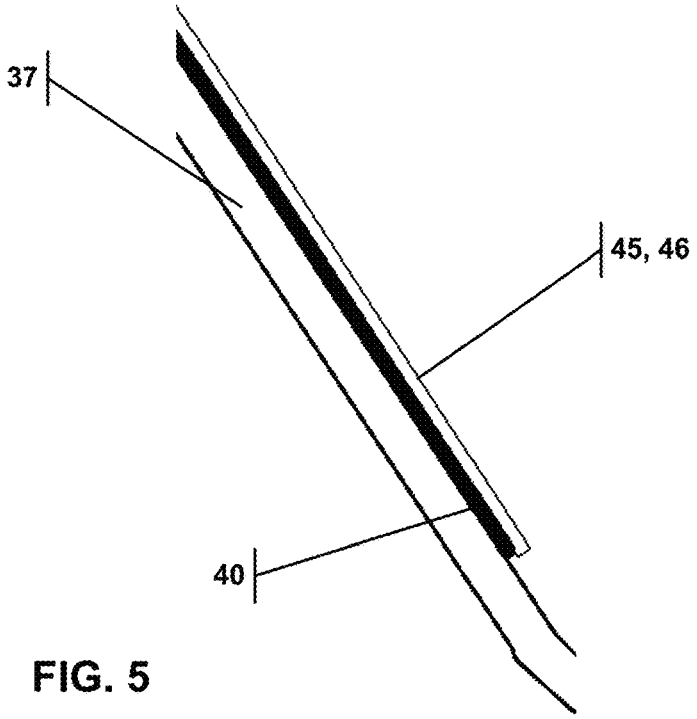
FIG. 5 is an enlarged view of the layers on the lid side of the scented patch.
Figure 6:
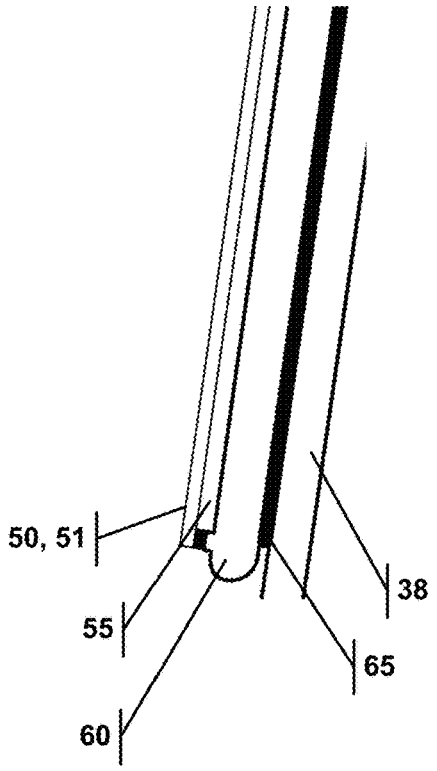
FIG. 6 is an enlarged view of the layers on the scent-impregnated side of the scented patch.

FIG. 3 is a cross-sectional view of a pleat 25 of the scented face mask 10 in a sealed configuration 11, and within this pleat 25 is the scented patch 35. FIG. 4 is a cross-sectional view of a pleat 25 of the scented face mask 10 in an unsealed configuration 12, with the pleat fold opened 27. As shown in FIGS. 5 and 6, the scented patch 35 includes the following subcomponents: a patch lid 45 attached with an adhesive layer 40 to the mask material before the pleat fold 37, a patch-impermeable layer 60 attached with an adhesive layer 65 to the mask material after the pleat fold 38, and a layer impregnated 55 with a scent agent attached to the patch-impermeable layer 60. Mechanical structures/fasteners may also be used to connect the patch lid 45 and impermeable layer 55 to the mask material, non-limiting examples of which include Velcro® and stitching. Ultrasonic welding or heat sealing may also be used.

Figure 2:
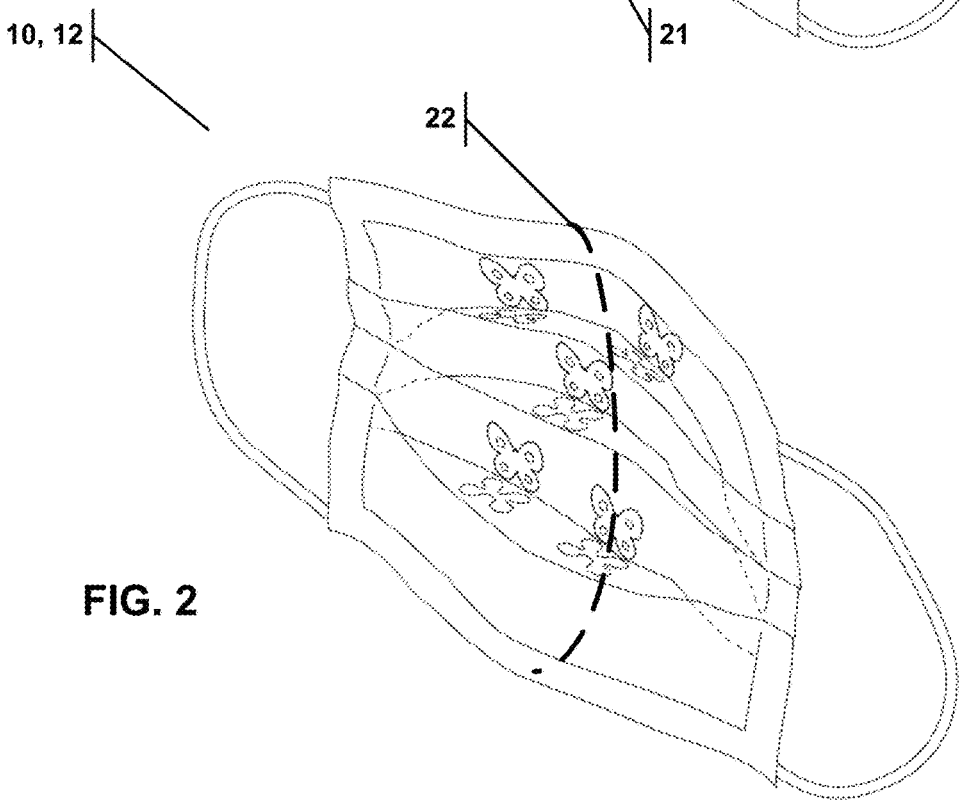
FIG. 2 is an isometric view of the scented face mask in an unsealed configuration.
Figure 9:
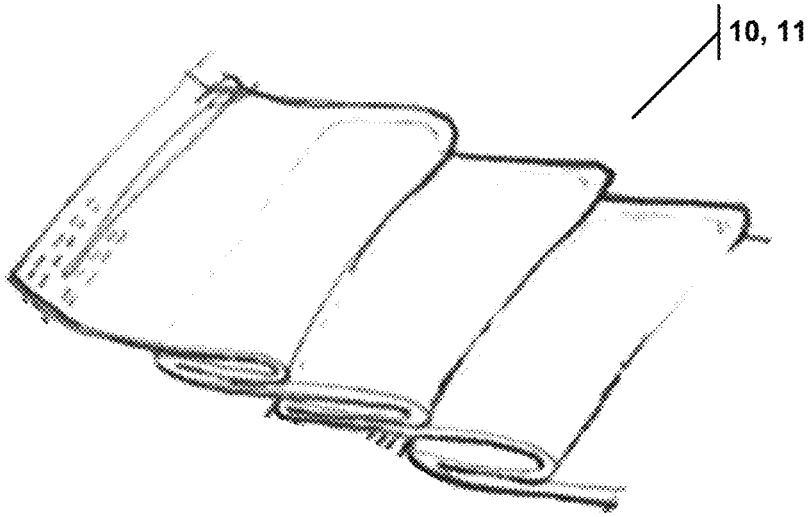
FIG. 9 is a top-side isometric view of a scented face mask in a sealed configuration, wherein the scented patches are of a clamshell design.
Figure 10:
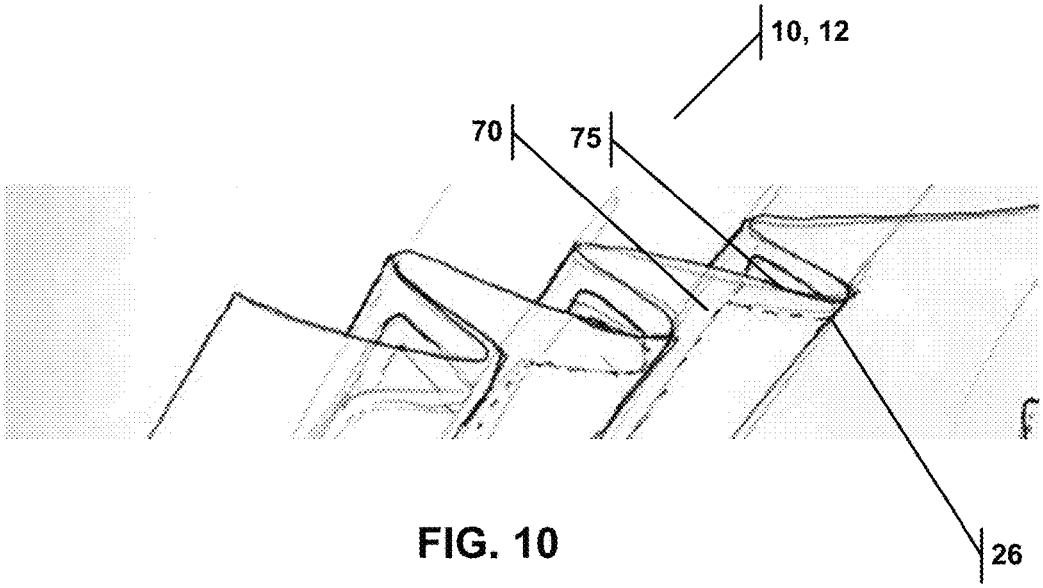
FIG. 10 is a top-side isometric view of a scented face mask in an unsealed configuration, wherein the scented patches are of a clamshell design.

The mask 10 has two different configurations: a sealed configuration 11 (see FIGS. 1, 3, 9) and an unsealed configuration (see FIGS. 2, 4, 10). The mask is delivered to a user in the sealed configuration 11 which is characterized by the mask material before 37 and after 38 the pleat fold 26 being folded on each other and the patch lid 45 forming a seal over the layer impregnated 55 with a scent agent. When in the sealed configuration, the patch lid 45 inhibits the vaporization of the scent agent. The height of the filter region is shown by line 21. When a user places the mask 10 over their nose and mouth, the mask 10 transitions to the unsealed configuration 12 wherein the pleat folds 26 open 27 (see FIG. 4), thus separating the patch lid 45 from the impregnated layer 55, allowing for the vaporization of the scent agent. The impregnated layer 55 in the unsealed configuration 11 may be exposed to the face-side. In the unsealed configuration 12, the filter region height (line 22) has extended relative to the sealed configuration. By selectively transitioning the mask from the sealed configuration 11 to the unsealed configuration 12, the scent agent is vaporized only when needed by the mask user. This prolongs the shelf life of the mask and permits the quick and hygienic vaporization of the scent without additional waste.

FIGS. 2 and 10 are isometric views of the scented face mask 10 in the unsealed configuration 12 with the pleats 25 opened, exposing the impregnated layer 55 to release the scent agent.

Figure 7:
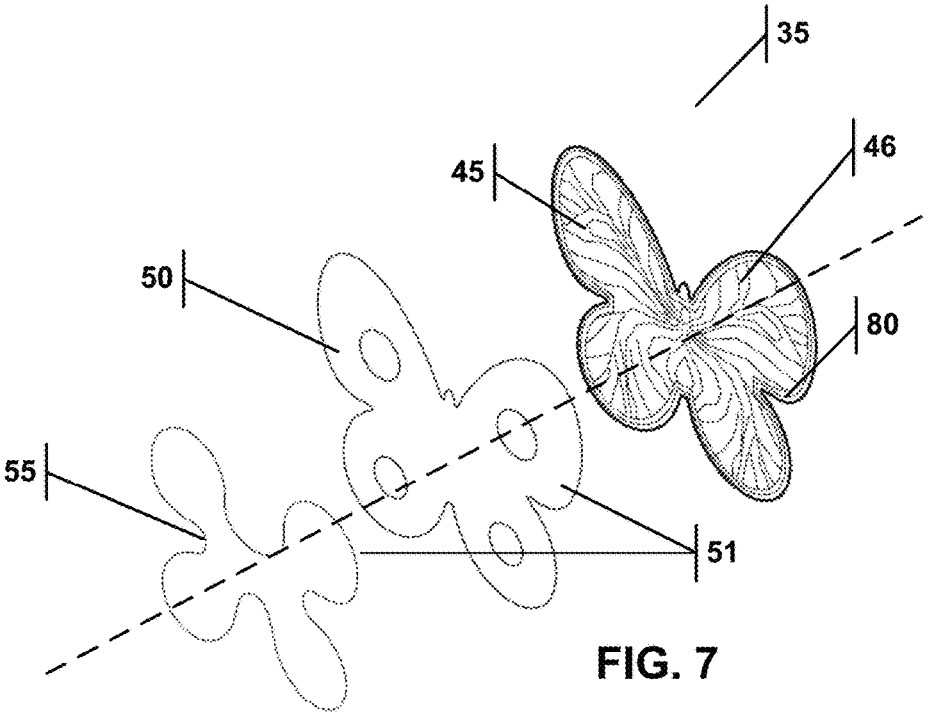
FIG. 7 is an exploded view of a scented patch in an ornamental design (i.e., a butterfly).

FIG. 7 is an exploded view of a scented patch 35 in an ornamental design (i.e., a butterfly). This patch 35 has an additional patch diffusion layer 50 on top of the impregnated layer 55, which controls the rate of vaporization of the scent agent. The patch lid 45 may be colored or patterned 46 on the inside such that when the mask 10 is in the sealed configuration 11, the color/patterned 46 is hidden. But when the mask 10 is in the unsealed configuration 12, the color/pattern 46 is exposed. This color/pattern indicator 46 allows the user to visually identify if the mask has already been unsealed, and thus should not be used. The color/pattern indicator 46 can also be used on the impregnated layer or the diffusion layer (see part 51).

Figure 8:
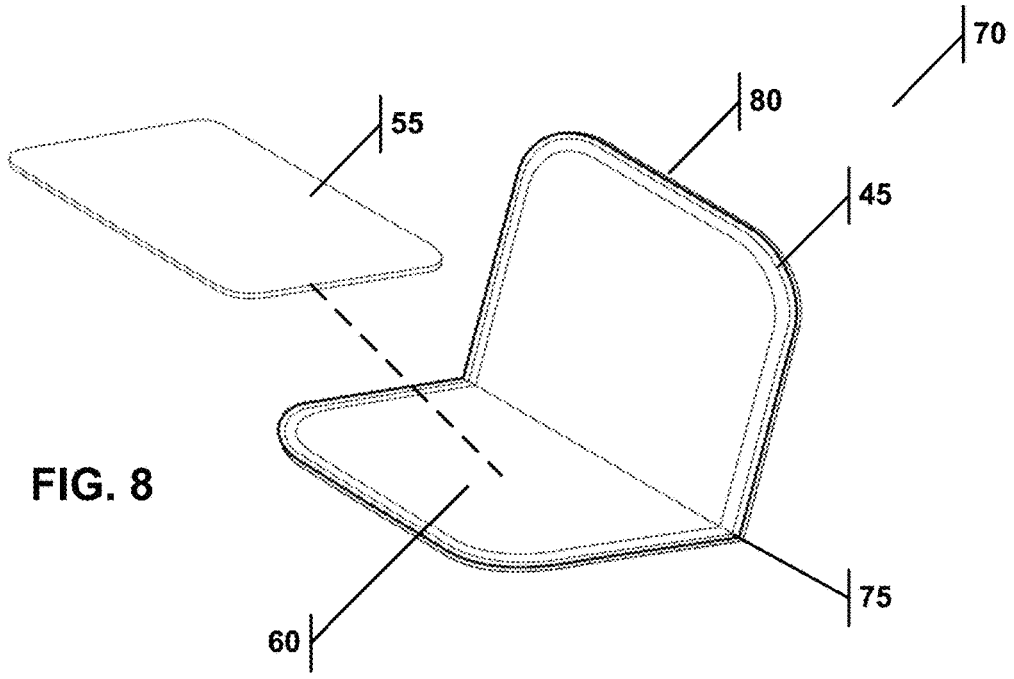
FIG. 8 is an exploded view of a scented patch in a clamshell embodiment.

FIG. 8 illustrates a second embodiment of the patch in a clamshell construction 70. Here, the patch lid 45 and patch-impermeable layer 60 are connected to each other by a patch hinge 75. As shown in FIG. 10, the patch hinge 75 is placed adjacent to the pleat fold 26, such that opening the pleat fold 26 would open the patch hinge 75, thus exposing the impregnated layer 55, allowing for the controlled vaporization of the scent agent.

The scent agent may include a binding agent or an antimicrobial that is selected from a group consisting of: carboxymethyl cellulose, pullulan, hydroxypropyl methyl cellulose, hydroxyethyl cellulose, hydroxypropyl cellulose, polyvinyl pyrrolidone, polyvinyl alcohol, sodium alginate, polyethylene glycol, Xanthan gum, tragacanth gum, guar gum, acacia gum, arabic gum, polyacrylic acid, methyl methacrylate copolymer, carboxyvinyl polymer, amylose, high amylose starch, hydroxypropylated high amylose starch, dextrine, pectin, chitin, chitosan, levan, elsinan, collagen, gelatin, Zein, gluten, soy protein isolate, whey protein isolate, casein, and combinations thereof.

The impregnated layer 55 may be constructed from plastic films with pores or micro-holes, paper, sponge-like films, films with encapsulated scent agents, treated plastic films, and combinations thereof.

Although exemplary embodiments and applications of the invention have been described herein including as described above and shown in the included example Figures, there is no intention that the invention be limited to these exemplary embodiments and applications or to the manner in which the exemplary embodiments and applications operate or are described herein. Indeed, many variations and modifications to the exemplary embodiments are possible, as would be apparent to a person of ordinary skill in the art. The invention may include any device, structure, method, or functionality, as long as the resulting device, system or method falls within the scope of one of the claims that are allowed by the patent office based on this or any related patent application.

The invention claimed is:

1. A mask comprising:

a filter region with one or more pleats, each pleat comprised of a mask material and a pleat fold;

one or more scented patches, each scented patch comprising:

a patch lid attached to the mask material before the pleat fold;

a patch-impermeable layer attached to the mask material after the pleat fold; and a layer impregnated with a scent agent attached to the patch-impermeable layer;

wherein the mask is constructed to transition from a sealed configuration to an unsealed configuration when a user places the mask over the user's nose and mouth:

the sealed configuration characterized in that the mask material before and after the pleat fold are folded on each other and the patch lid covers and seals the impregnated layer, inhibiting the vaporization of the scent agent; and the unsealed configuration characterized in that the pleat fold is opened and the patch lid is separated from the impregnated layer, allowing for the vaporization of the scent agent.

2. The mask of claim 1, further comprising a patch diffusion layer covering at least a portion of the impregnated layer when in the unsealed configuration, the patch diffusion layer constructed to control the rate of vaporization of the scent agent.

3. The mask of claim 1, further comprising an elastic strap to maintain the position of the mask on the user.

4. The mask of claim 1, further comprising memory metal strip constructed to shape an edge of the mask around the user's nose.

5. The mask of claim 1, comprising a face-side and an environmental side, and when in the unsealed configuration the impregnated layer is exposed to the face-side.

6. The mask of claim 1, wherein either or both of the patch lid and the patch-impermeable layer are attached to the mask material by an adhesive.

7. The mask of claim 1, wherein either or both of the patch lid and the patch-impermeable layer are attached to the mask material by a mechanical fastener.

8. The mask of claim 1, wherein either or both of the patch lid and the patch-impermeable layer are attached to the mask material by ultrasonic welding or heat bonding.

9. The mask of claim 1, wherein the patch lid and the patch-impermeable layer are connected to each other by a patch hinge.

10. The mask of claim 9, wherein the patch hinge is adjacent to the pleat fold.

11. The mask of claim 1, wherein the scented patch is shaped like a butterfly silhouette.

12. The mask of claim 1, wherein the scent agent includes an antimicrobial.

13. The mask of claim 12, wherein the antimicrobial is selected from a group consisting of: carboxymethyl cellulose, pullulan, hydroxypropyl methyl cellulose, hydroxyethyl cellulose, hydroxypropyl cellulose, polyvinyl pyrrolidone, polyvinyl alcohol, sodium alginate, polyethylene glycol, Xanthan gum, tragacanth gum, guar gum, acacia gum, arabic gum, polyacrylic acid, methyl methacrylate copolymer, carboxyvinyl polymer, amylose, high amylose starch, hydroxypropylated high amylose starch, dextrine, pectin, chitin, chitosan, levan, elsinan, collagen, gelatin, Zein, gluten, soy protein isolate, whey protein isolate, casein, and combinations thereof.

14. The mask of claim 1, wherein the scent agent includes a binding agent.

15. The mask of claim 1, wherein the impregnated layer is selected from a group consisting of: plastic films with pores or micro-holes, paper, sponge-like films, films with encapsulated scent agents, treated plastic films, and combinations thereof.

16. The mask of claim 1, wherein the scented patch contains an indicator that is hidden when the mask is in the sealed configuration and exposed when the mask is in the unsealed configuration.

17. The mask of claim 16, wherein the indicator is a color and/or a pattern.

18. The mask of claim 1, wherein the patch-impermeable layer is comprised of a controlled release material.

* * * * *